US005458240A

United States Patent [19]

Rich et al.

[11] Patent Number: 5,458,240

[45] Date of Patent: Oct. 17, 1995

[54] GOLF BAG WITH INDIVIDUAL CLUB HEAD SUPPORT POCKETS

[76] Inventors: Philip R. Rich, 217 S. 122nd St., Omaha, Nebr. 68144; Charles E. Powers, P.O. Box 173, 102 E. South St., Exira, Iowa 50076

[21] Appl. No.: 998,419

[22] Filed: Dec. 30, 1992

[51] Int. Cl.[6] ..... A63B 55/00

[52] U.S. Cl. ..... 206/315.3; 206/315.6; 206/315.8

[58] Field of Search ..... 206/315.2–315.6

[56] References Cited

U.S. PATENT DOCUMENTS

| | | | |
|---|---|---|---|
| 1,119,508 | 12/1914 | Headley | 206/315.4 |
| 1,271,784 | 7/1918 | Simpson | 206/315.6 |
| 1,717,959 | 6/1929 | Cauffman | 206/315.6 |
| 1,788,478 | 1/1931 | Beaty et al. | 206/315.6 |
| 1,840,183 | 1/1932 | Blitch | 206/315.6 |
| 1,849,610 | 3/1932 | Boyce | 206/315.6 |
| 1,951,158 | 3/1934 | Locke et al. | 206/315.6 X |
| 2,436,687 | 2/1948 | Corbett | 206/315.6 |
| 2,534,096 | 12/1950 | Zapoleon | 206/315.6 |
| 2,685,317 | 8/1954 | Lace | 150/1.5 |
| 2,751,955 | 6/1956 | Nahon | 206/315.6 |
| 2,752,973 | 7/1956 | Stamp | 150/1.5 |
| 2,879,819 | 3/1959 | Turnbull | 206/315.4 |
| 2,925,840 | 2/1960 | Hird | 150/1.5 |
| 3,053,298 | 9/1962 | Stamp | 150/1.5 |
| 3,460,597 | 8/1969 | Daly | 206/315.6 X |
| 3,842,876 | 10/1974 | Cristelli | 206/315.6 X |
| 3,901,299 | 8/1975 | Picco | 206/315.4 |
| 3,941,398 | 3/1976 | Nelson | 206/315.6 X |
| 4,055,207 | 10/1977 | Goodwin | 206/315.6 |
| 4,173,241 | 11/1979 | Stock | 150/1.5 |
| 4,181,167 | 1/1980 | Ret | 206/315.6 |
| 4,194,547 | 3/1980 | Sidor et al. | 206/315.6 |
| 4,200,131 | 4/1980 | Chitwood et al. | 206/315.6 |
| 4,208,227 | 6/1980 | Cowan | 206/315.6 |
| 4,263,950 | 4/1981 | Brown | 206/315.6 X |
| 4,332,283 | 6/1982 | Rader | 206/315.6 |
| 4,383,563 | 5/1983 | Kirchhoff, Jr. | 206/315.5 X |
| 4,955,472 | 9/1990 | Yamazoe | 206/315.6 |
| 4,995,332 | 2/1991 | Tsuruoka et al. | 118/66 |
| 4,995,510 | 2/1991 | Fletcher, Jr. | 206/315.6 |

*Primary Examiner*—Sue A. Weaver

[57] ABSTRACT

A golf bag is provided for supporting and protecting a plurality of golf clubs. The golf bag includes an upper club head support having a plurality of pockets each having one or more shaft-receiving holes formed therein. Each of the pockets is formed to support and protect at least one club head placed therein, whereby a golf club may be inserted shaft first into a pocket, the golf club shaft extending through one of the shaft-receiving holes, the golf club being inserted until the upper part of the club head is supported and protected within the pocket. The golf bag also includes a lower base section for supporting the golf bag and support means extending between and connected to the upper club head support and the lower base section such that the upper club head support may be supported in spaced relation from the lower base section. Extending between and attached to the upper club head support and lower base section is a bag-forming material which forms a cylinder-like interior protected area. Each of the pockets is formed such that each club head supported by the upper club head support is fully protected from contact with any other club head supported thereby.

3 Claims, 12 Drawing Sheets

GOLF BAG WITH INDIVIDUAL CLUB HEAD SUPPORT POCKETS

BACKGROUND OF THE INVENTION

1. Technical Field

This invention relates to golf bags and, more particularly, to a golf bag having a plurality of pockets for supporting a plurality of golf clubs, the pockets preventing any club head from contacting any other club head.

2. Description of the Prior Art

Many golf bags are known for supporting and separating golf clubs to allow for better organization of the golf clubs in the bag. Examples of such golf club separators include Stamp, U.S. Pat. No. 2,752,973 and Stamp, U.S. Pat. No. 3,053,298, both of which show an insert for a golf bag that is designed to accommodate four woods and to separate the heads in separate compartments thereof. However, both Stamp patents exhibit an accessory for a standard golf bag and do nothing to protect the club heads of the irons. Moreover, because of the flared top portion, multiple inserts to accommodate the irons as well would not fit in a golf bag.

Lace et al., U.S. Pat. No. 2,685,317, likewise discloses a golf bag having separate compartments for the woods and two open top compartments for the irons where the club heads of the irons would contact one another. Because the compartments for the woods are extended across the top of the golf bag, there would be insufficient room for additional compartments for the irons.

Therefore, while the broad concept of providing separate compartments for receiving and protecting the heads of golf clubs is known and unpatentable, no example can be found in the prior art which discloses a golf bag which, when accommodating clubs, will fully protect each club from contact with any other club.

Such a golf club bag would be most welcome by golfers who have the useful life of their clubs cut short by repeated contact between clubs while in the bag. There is therefore a need for such a bag.

Accordingly, an object of the present invention is to provide an improved golf club bag.

Another object of the present invention is to provide a golf club bag having a plurality of pockets to accommodate and support a golf club placed therein.

Yet another object of the present invention is to provide a golf club bag having a plurality of pockets which, when golf clubs are placed therein, will prevent each club from making contact with any other club, thus preventing damage to the golf club heads.

Another object of the present invention is to provide a golf club bag having a plurality of removable pockets for protection of golf clubs which thus allows individual pockets to be removed and cleaned or replaced.

Still another object of the present invention is to provide a golf club bag which may be covered by a top cover, the top cover then being secured in place, thus eliminating the need for separate travel bags for the clubs.

Yet another object of the present invention is to provide a golf club bag which is refined in appearance and functional in shape.

Finally, an object of the present invention is to provide a golf club bag which is simple to manufacture and safe and durable in use.

SUMMARY OF THE INVENTION

The present invention provides a golf bag for supporting and protecting a plurality of golf clubs. The golf bag consists of an upper club head support having a plurality of pockets each having a shaft receiving hole formed therein. Each of the pockets is formed to support and protect a club head placed therein, whereby a golf club may be inserted shaft first into a pocket. The golf club shaft extends through one of the shaft-receiving holes, and is inserted until the upper part of the club head, which, during insertion, is facing downwards, is supported and protected by the pocket. Also included is a lower base section for supporting the golf bag. Extending between and connected to the upper club head support and lower base section are one or more generally rigid dowels which support the upper club head support in spaced vertical relation from the lower base section. Finally, to form the golf bag, a bag-forming material is attached to and extended between the upper club head support and lower base section such that the interior area of the bag may be protected. The pockets as thus formed support and protect each club placed therein, fully preventing contact with any other club head supported by the upper club head support.

An alternative embodiment would modify the upper club head support to include a two-tier pocket structure, the upper tier for supporting a number of woods, and the lower tier for supporting a number of irons. Such an embodiment would not only provide protection for the clubs, but would provide for additional organizational capacity.

The golf bag as thus described provides a substantial improvement over those bags found in the prior art. Not only is the bag of the present invention more organized than other bags, but damage to clubs resulting from incidental contact with one another is eliminated. Moreover, as the pockets may be constructed of a softer plastic to prevent scratches to club surfaces, such damage can also be eliminated.

Finally, as the bag of the present invention may be provided with a cover, a golfer may use the same golf bag for both the golf course and for traveling. Therefore, this golf bag is superior to that found in the prior art.

DESCRIPTION OF THE PREFERRED EMBODIMENT

Figure 1:
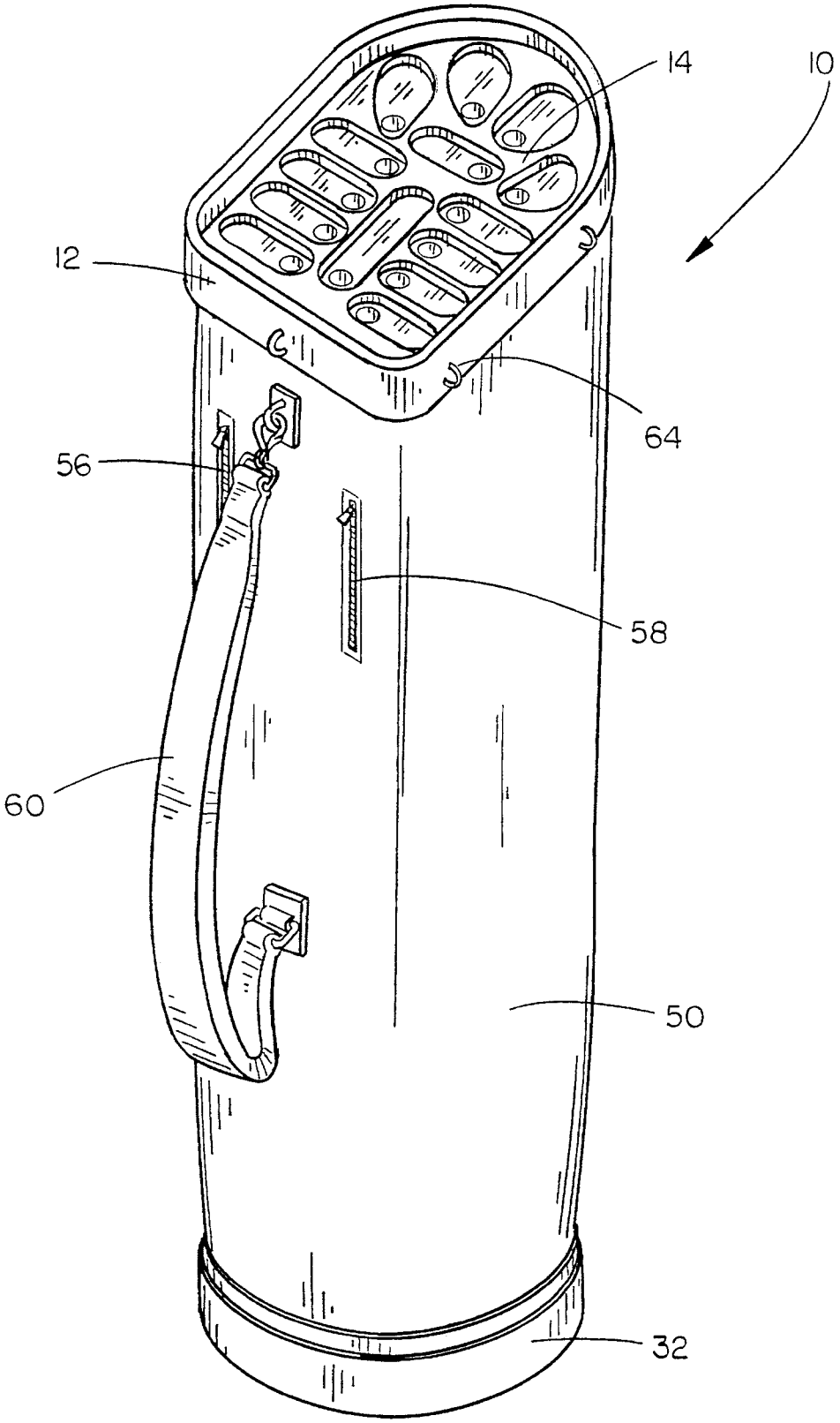
FIG. 1 is a perspective view of the golf bag.
Figure 2:
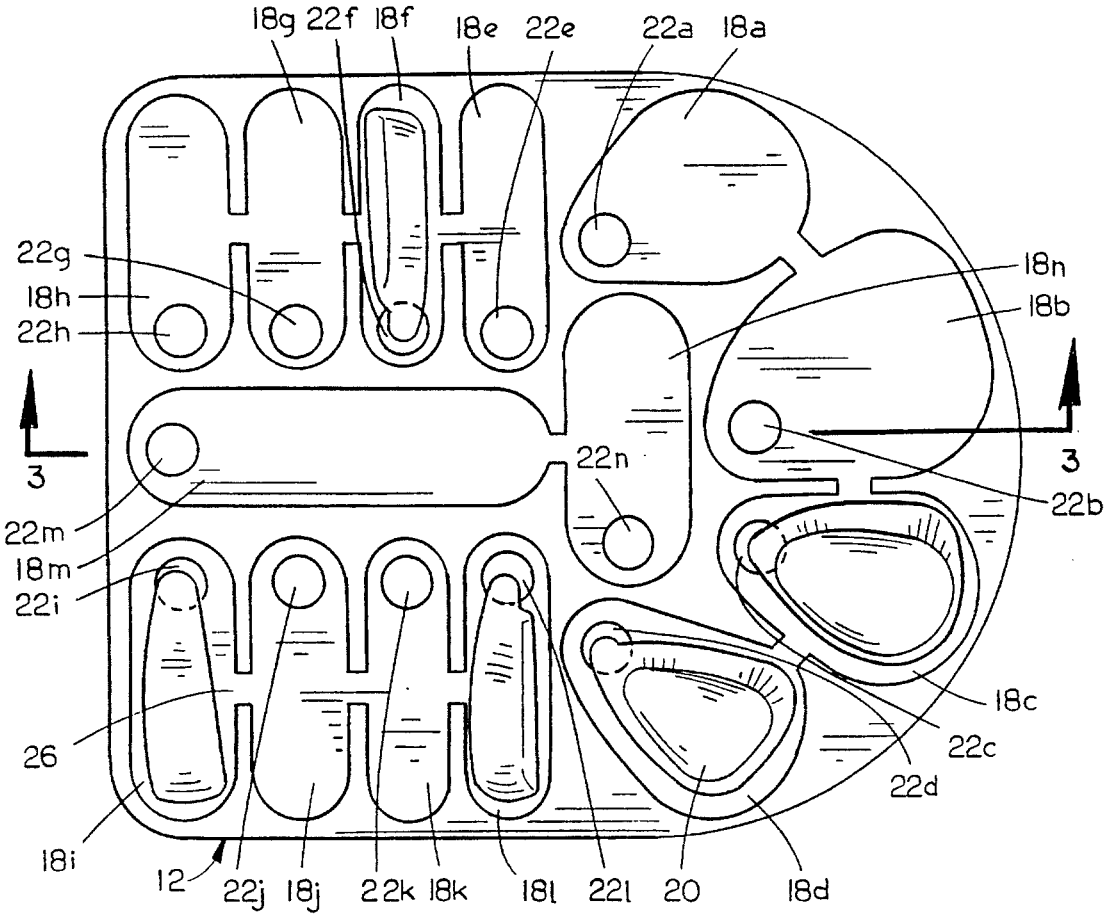
FIG. 2 is a top plan view of the upper club head support of the golf bag.

The golf bag 10 of the present invention is shown in its preferred embodiment in FIGS. 1, 2, 7 and 9 as including an upper club head support 12 having a slanted top surface 14 and a slanted bottom plane 16 defined by the lower edge 24 of the outer wall 28 of the upper club head support 12. The slanted bottom plane 16 is merely used in this description for simplifying various element descriptions. It is preferred that the top surface 14 of the upper club head support 12 be shaped somewhat as a rectangle connected to a semi circle, as shown in FIG. 2. This description is merely for clarification of the shape of the upper club head support 12, as it is preferred that the upper club head support 12 be formed from a molded piece of plastic, and thus be a unified structural element. It is preferred that the width of the upper club head support 12 be between 7" and 17", the length of the upper club head support 12, as measured from the top edge of the semi-circle to the bottom edge of the rectangle, be between 9" and 20" and that the depth be between 2" and 9".

Formed when the upper club head support 12 is molded are a plurality of club head pockets 18*a–n* for receiving, supporting and protecting a club head 20 placed therein. Each club head pocket 18*a–n* is formed to accommodate a specific golf club. In the preferred embodiment shown, club head pockets 18*a–d* are designed to accommodate various woods, including driver and fairway woods, club head pockets 18*e–l* are designed to accommodate the 2–9 irons, club head pocket 18*m* is designed to accommodate a pitching or sand wedge and club head pocket 18*n* is designed to accommodate a putter. The pockets 18*a–n* may be sized to accommodate various sized club heads, such as the newer jumbo woods. Each club head pocket 18*a–n* is preferably 1–4" in depth, although this depth is not critical as long as protection is provided. The depth is easily changeable depending on the plastic mold used to form the upper club head support 12. Extending downward from the base of each of the pockets 18*a–n* towards the slanted bottom plane 16 are shaft-receiving holes 22*a–n* each designed to accommodate the shaft of a golf club when the golf club is placed into a pocket 18*a–n* shaft and first. It is preferred that each shaft-receiving hole 22*a–n* be approximately 1" in diameter, although the diameter of the shaft-receiving hole 22*a–n* need only be less than the length of the club head 20 to prevent the club from falling into the golf bag 10.

The pockets 18*a–n* as thus described virtually eliminate the need for head covers for the clubs carried in the bag, as the club heads 20 are protected from contact with each other. Furthermore, the upper club head support 12 may include grooves or slots 26, shown in FIG. 2, extending between the pockets 18*a–n* , for allowing easier access to club heads 20 supported within said pockets 18*a–n*.

Figure 3:
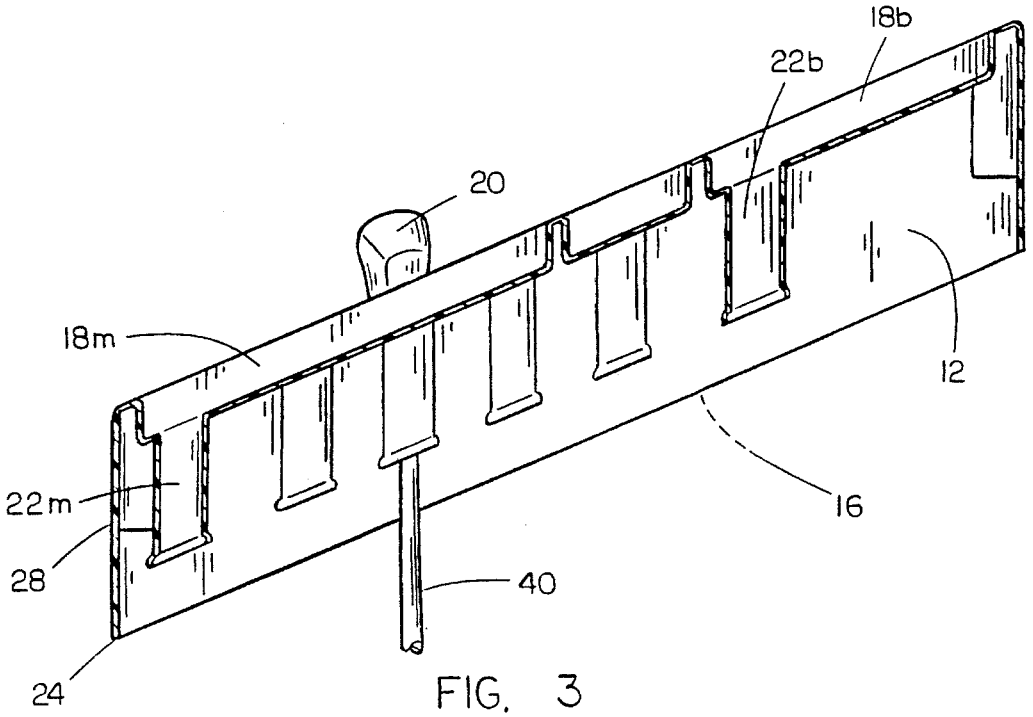
FIG. 3 is a side sectional view of the upper club head support taken along line 3—3 in FIG. 2.
Figure 8:
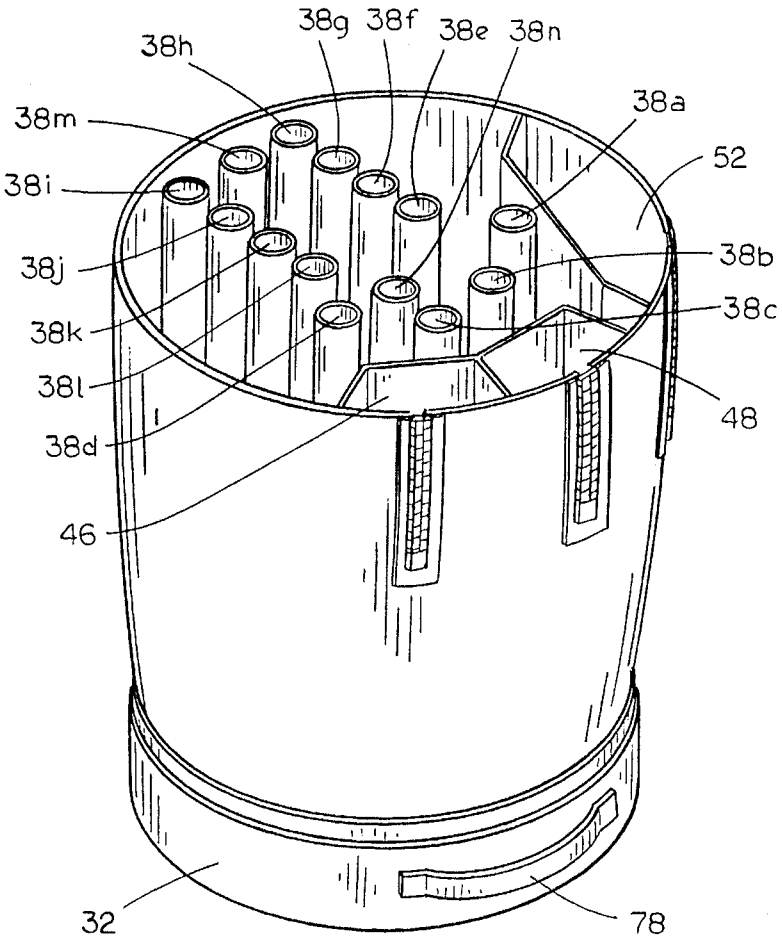
FIG. 8 is an enlarged perspective sectional view taken along plane 8—8 in FIG. 7.
Figure 9:
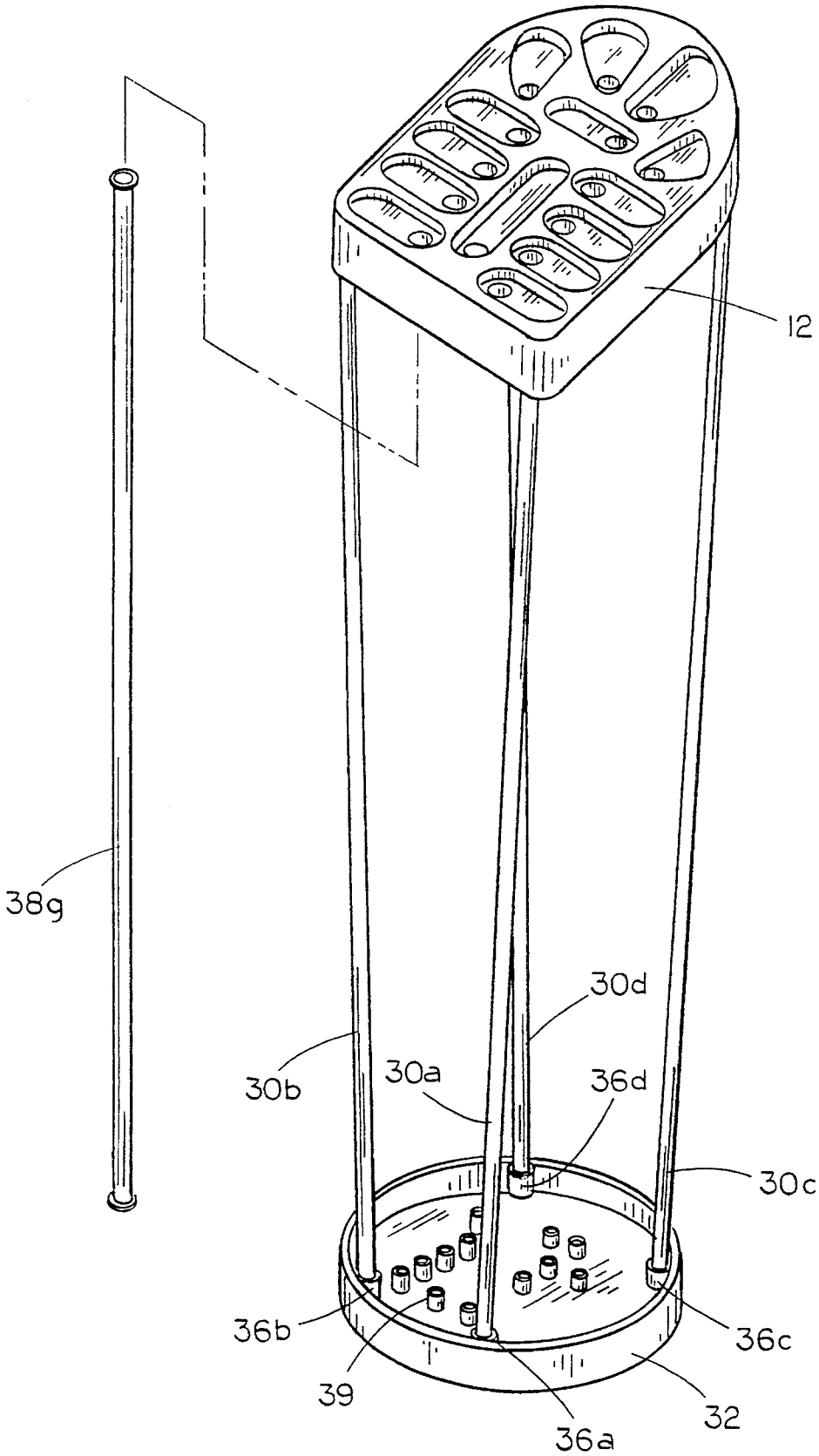
FIG. 9 is a perspective view of the golf bag frame.

It is preferred that the upper club head support 12 be formed such that it may be supported at an upward angle as shown in FIG. 3. This angle serves two main purposes, one, access to the club heads 20 is greatly facilitated, and two, the longer club shafts of woods may be accommodated by the upper pockets 18*a–d* and still allow the club heads to be protected. The angle of the upper club head is preferably between 5°–45° above horizontal to provide the easiest access to club heads Extending downwards from and connected to the upper club head support 12 are four support dowels 30*a–d*, as shown in FIG. 9, each connected to a lower base section 32 such that the upper club head support 12 may be supported in vertically spaced relation from the lower base section 32. It is preferred that the overall height of the golf bag 10 be between 35" and 55" the height dependent on the length of the support dowels 30*a–d*. In this manner, even the longest shafted woods and shortest shafted irons may be accommodated. It is preferred that the upper club head support and lower base section 32 would have a plurality of support dowel receiving holes 34*a–d* and 36*a–d* each designed to receive and hold one end of a dowel 30*a–d*. Extending downwards from and connected to the lower end of each shaft receiving hole 22*a–n* are shaft tubes 38*a–n*, each of which extends downwards to contact the lower base section 32 as shown in FIGS. 8 and 9. The shaft tubes 38*a–n* provide further separation for the club shafts 40, thus preventing tangling of the various clubs.

Figure 4:
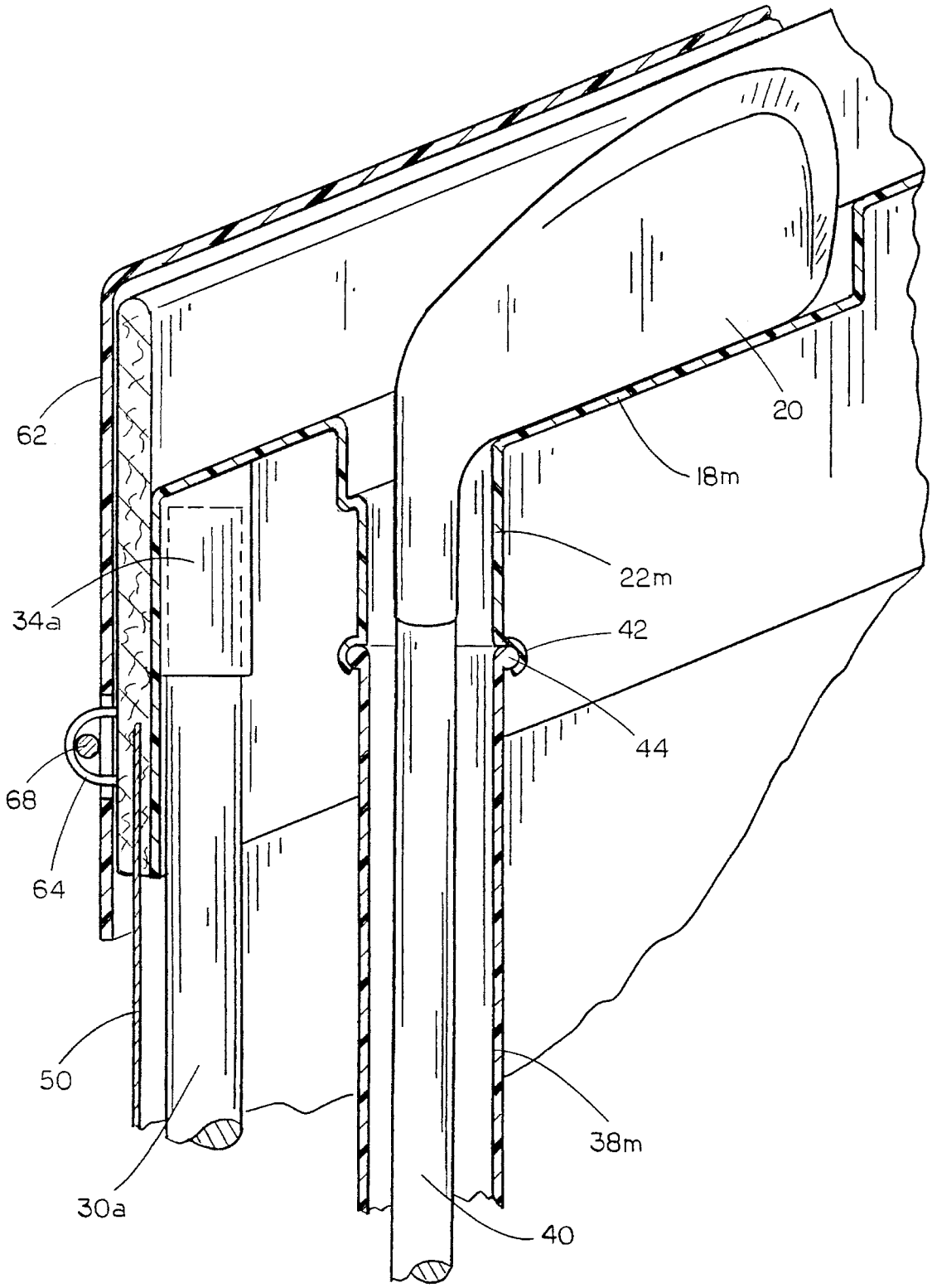
FIG. 4 is an enlarged partial side sectional view showing an iron situated within a respective pocket of the upper club head support.
Figure 5:
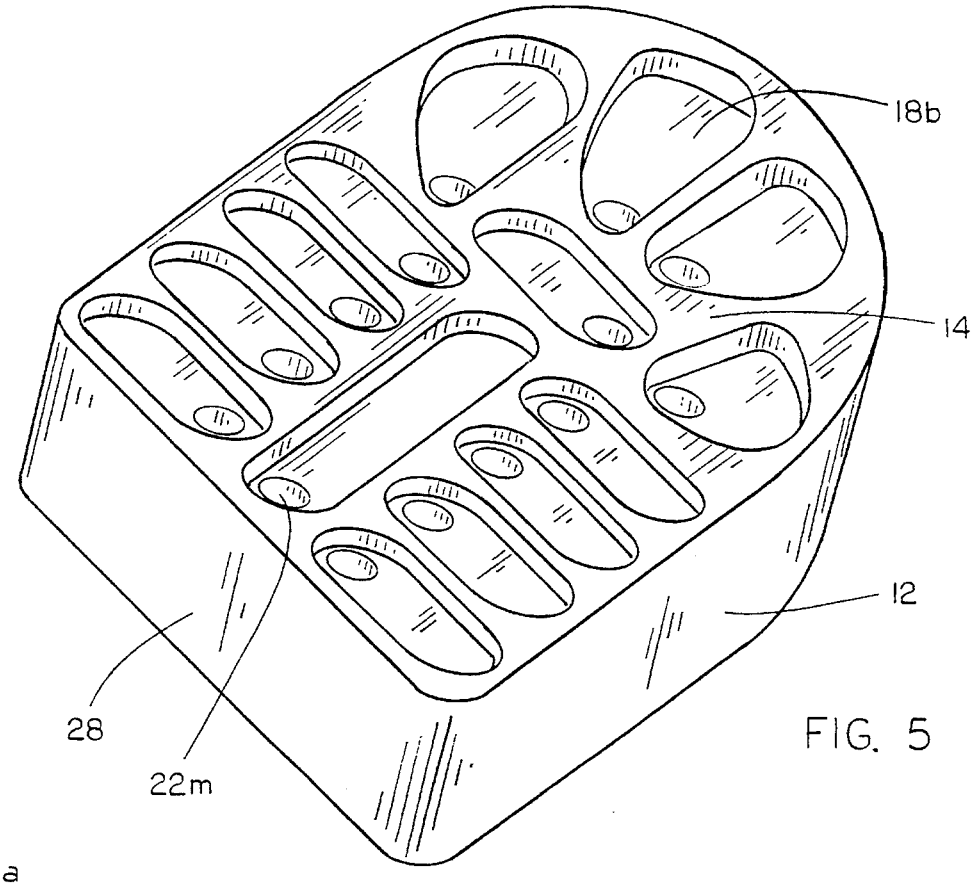
FIG. 5 is a perspective view of the upper club head support.
Figure 6:
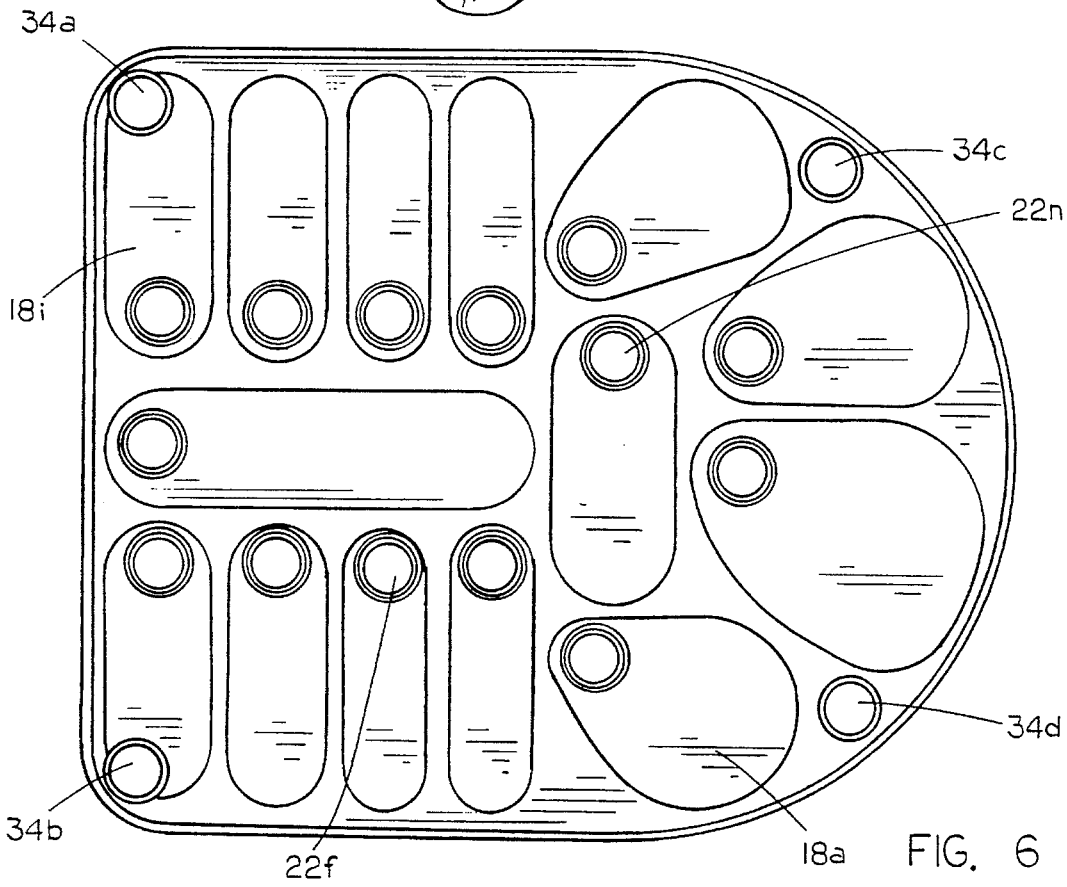
FIG. 6 is a bottom view of the upper club head support.

The connection between the bottom of the shaft receiving holes 22*a–n* and the top of the shaft tube 38*a–n* is shown in FIG. 4 by a snap fit connector 42 which engages the top rolled end 44 of a shaft tube 38*a–n*. The shaft tubes 38*a–n* thus may be inserted and/or removed as needed, as shown in FIG. 9.

In a preferred embodiment, the shaft tubes 38*a–n* extend the entire distance between the bottom of the shaft receiving holes 22*a–n* and the lower base section 32. The lower base section 32 may include snap-fit connectors 39 which engage the lower ends of the shaft tubes 38*a–n* and secure the shaft tubes in position. The combination of the pockets 18*a–n* and shaft tubes 38*a–n* thus provides total protection for a club supported therein, thus acting as a kind of reverse head cover. This total protection concept is especially important for newer clubs, such as those having graphite-boron composite shafts which can be easily damaged by repeated contact with other club shafts. Furthermore, as the shaft tubes 38*a–n* may be constructed of alternative materials such as rubber tubing or fabric-like stockings and the pockets 18*a–n* may be constructed of soft plastic, foam rubber, a rubber compound or simply lined with fur, a user of the golf bag 10 of the present invention may tailor the protection capabilities of the invention to suit his or her individual needs.

Figure 7:
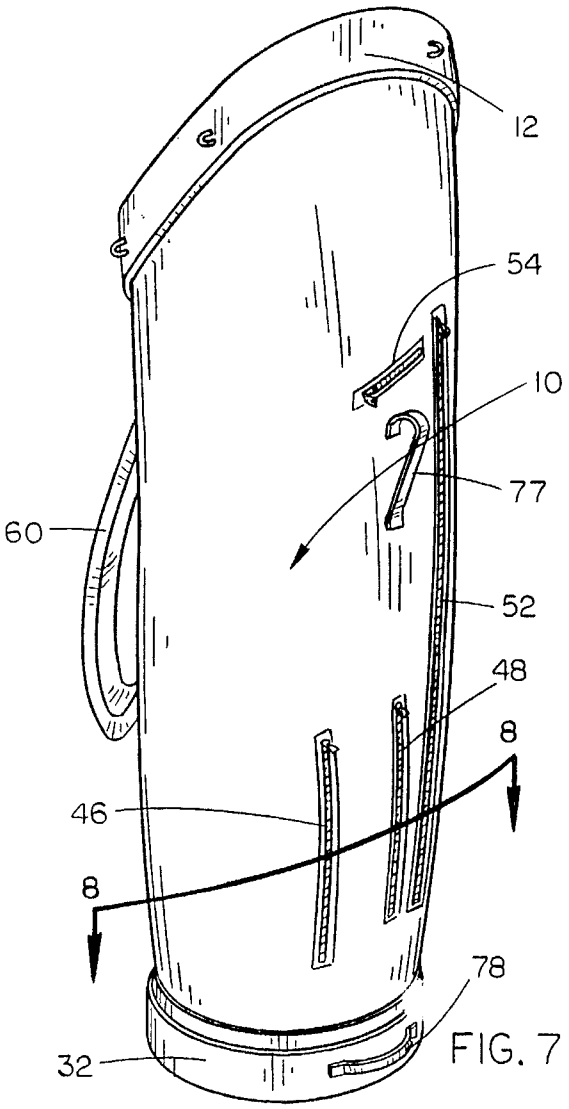
FIG. 7 is another perspective view of the golf bag.

FIG. 8 exhibits the internal structure of the golf bag 10 as including the shaft tubes 38*a–n* and various pockets 46, 48 and 52. The golf bag 10 thus provides for storage of various golfing accessories, such as shoes, tees and balls. FIGS. 1 and 7 exhibit additional zippered pockets 54, 56 and 58. Furthermore, a carrying strap 60 may be provided to assist in the transporting of the golf bag 10. Also, a middle brace (not shown) similar to the upper club head support 12 may be positioned on the dowels 30*a–d* approximately halfway between the upper club head support 12 and lower base section 32 to provide additional structural rigidity for the golf bag 10.

Figure 10:
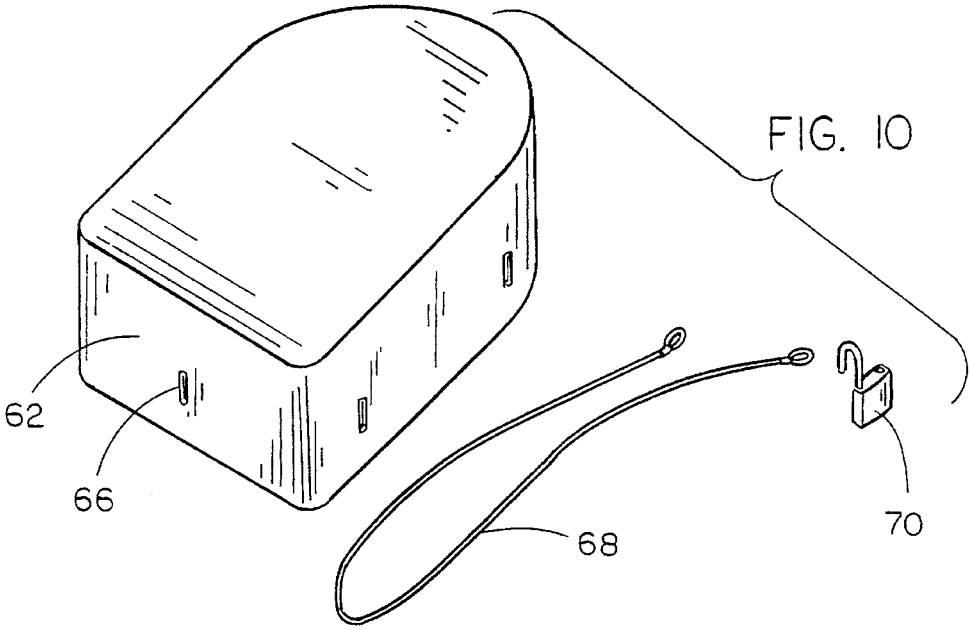
FIG. 10 is a perspective view of the top cover and lock cable.
Figure 11:
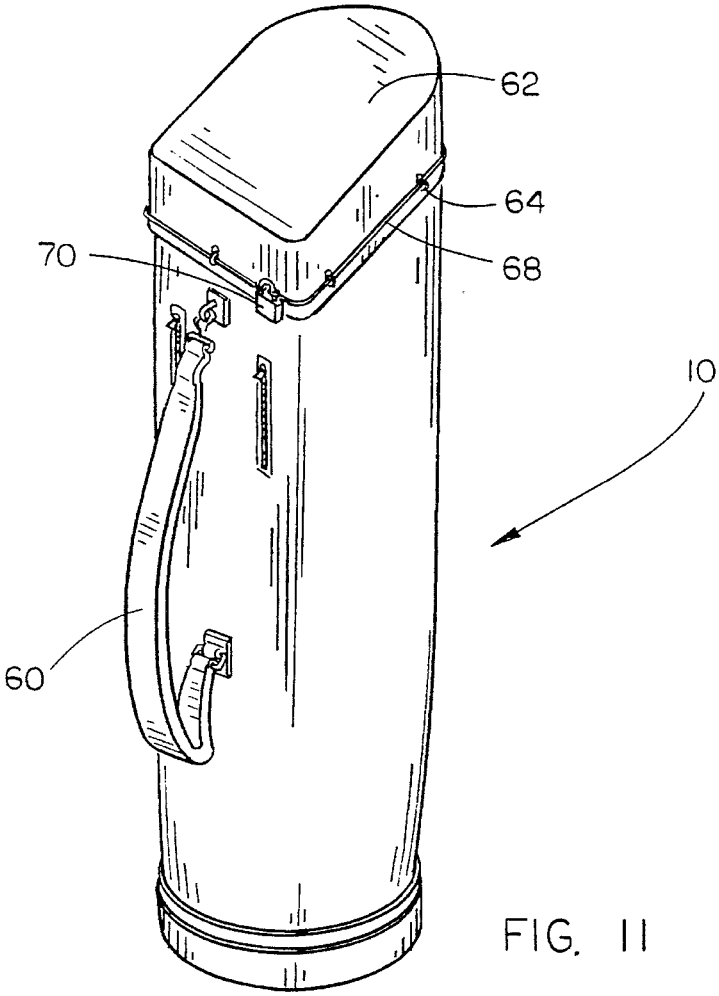
FIG. 11 is a perspective view of the golf bag with the top cover locked onto the bag to secure the clubs therein.

As shown in FIGS. 4, 10 and 11, a golf bag cover 62 may be provided which is designed to fit over the upper club head support 12, thus enclosing club heads 20 secured within the club head pockets 18*a–n*. The golf bag cover 62 is preferably formed of a semi-rigid plastic similar to that used to form the upper club head support 12, the cover 62 having the same general shape as the upper club head support 12. Mounted on the outer wall 28 of the club head support 12 are a plurality of C-rings 64, shown best in FIGS. 1 and 4. When the golf bag cover 62 is placed over the upper club head support 12, the C-rings 64 may extend outward through slots 66 formed in the sides of the golf bag cover 62. The cover may then be secured in place by sliding a securement strap 68, shown in FIG. 10, through the C-rings 64, as shown in FIG. 11, and locking the opposite ends of the securement strap 68 together with a lock 70. The golf bag 10 thus may be used to transport clubs while eliminating the need for separate travel bags. Furthermore, the golf bag 10 may also include locking zippers for each of the pockets to provide additional security for golf accessories held within the zippered pockets. Alternatively, the golf bag cover 62 may extend downwards beyond the lower edge 24 of the outer wall 28 of the upper club head support 12 and cover the zippers of one or more pockets to prevent the pocket from being opened when the cover 62 is in place. In this embodiment, there is no need for locking zippers on the pockets and thus additional security is provided for golf equipment stored within the pockets.

Alternative golf bag covers may include a zipper to allow access to the interior of the bag without having to remove the cover, or a snap-on cover which is attached much the same as a standard plastic coffee can lid. These covers would be used more for protection of clubs while golfing, and not as much for travel on airplanes or the like.

Figure 12:
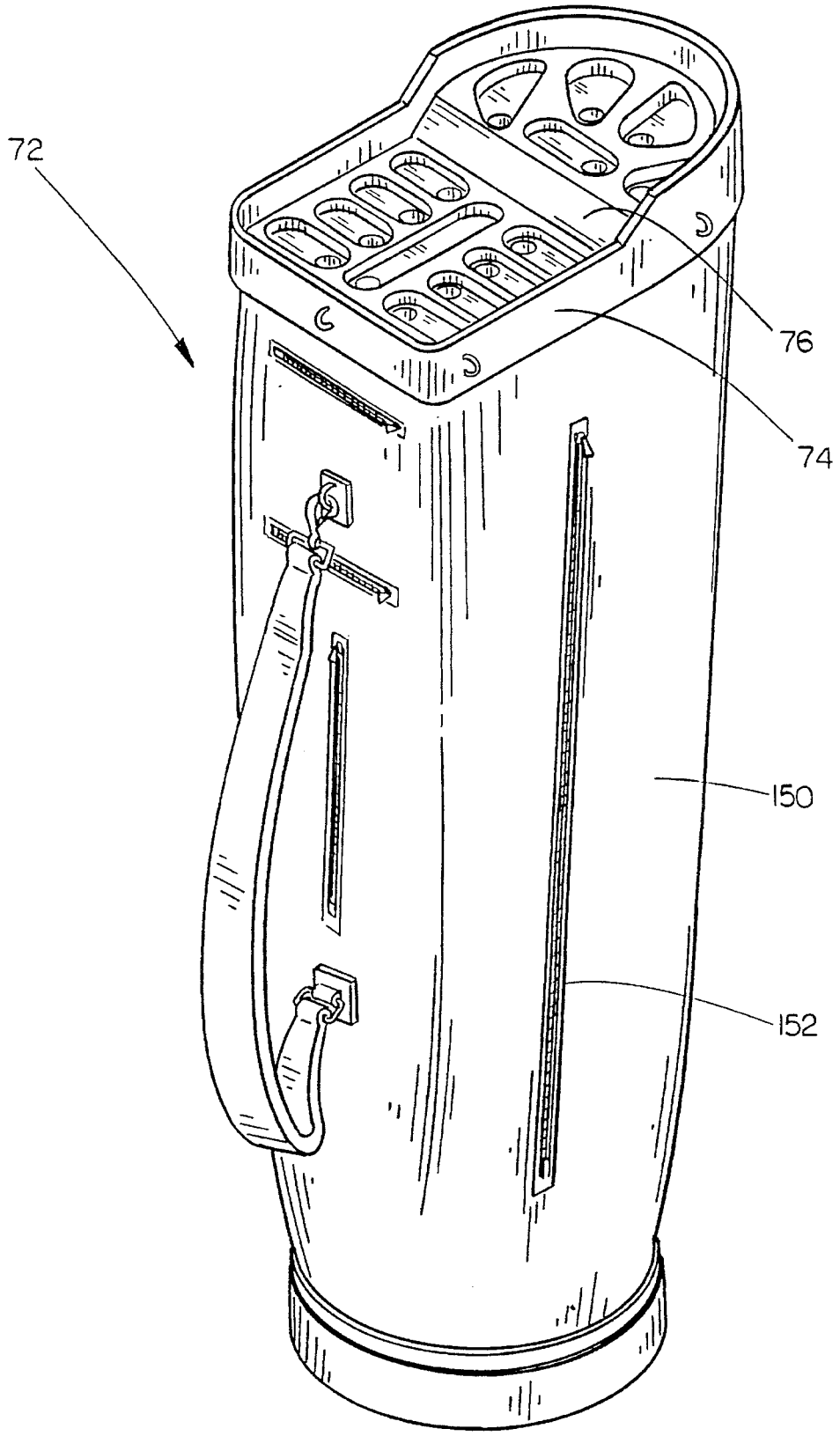
FIG. 12 is a perspective view of an alternative embodiment illustrating the stepped slope between the pockets for the woods and irons on the upper club head support.

Shown in FIG. 12 is an alternative embodiment of the golf bag 72 of the present invention. The general design of the golf bag 72 remains similar to that shown in FIG. 1, however, the upper club head support 74 has been modified. Whereas the upper club head support 12 in FIG. 1 has an angled upper surface to provide easier access to club heads held therein, the alternative embodiment of FIG. 12 has an upper club head support 74 having a step 76 to divide the woods and putter from the irons below. In a preferred embodiment, the step 76 is between 2" and 6" in height, thus spacing the upper tier from 2" to 6" above the lower tier. This embodiment provides similar club protection while adding additional organization to the clubs contained therein. This embodiment may also appeal to more traditional golfers, as the upper club head support 74 of this embodiment does not have as pronounced a slope as that found in FIG. 12. However, both embodiments provide novel organizational apparatus for separating and protecting golf club heads contained therein.

Figure 13:
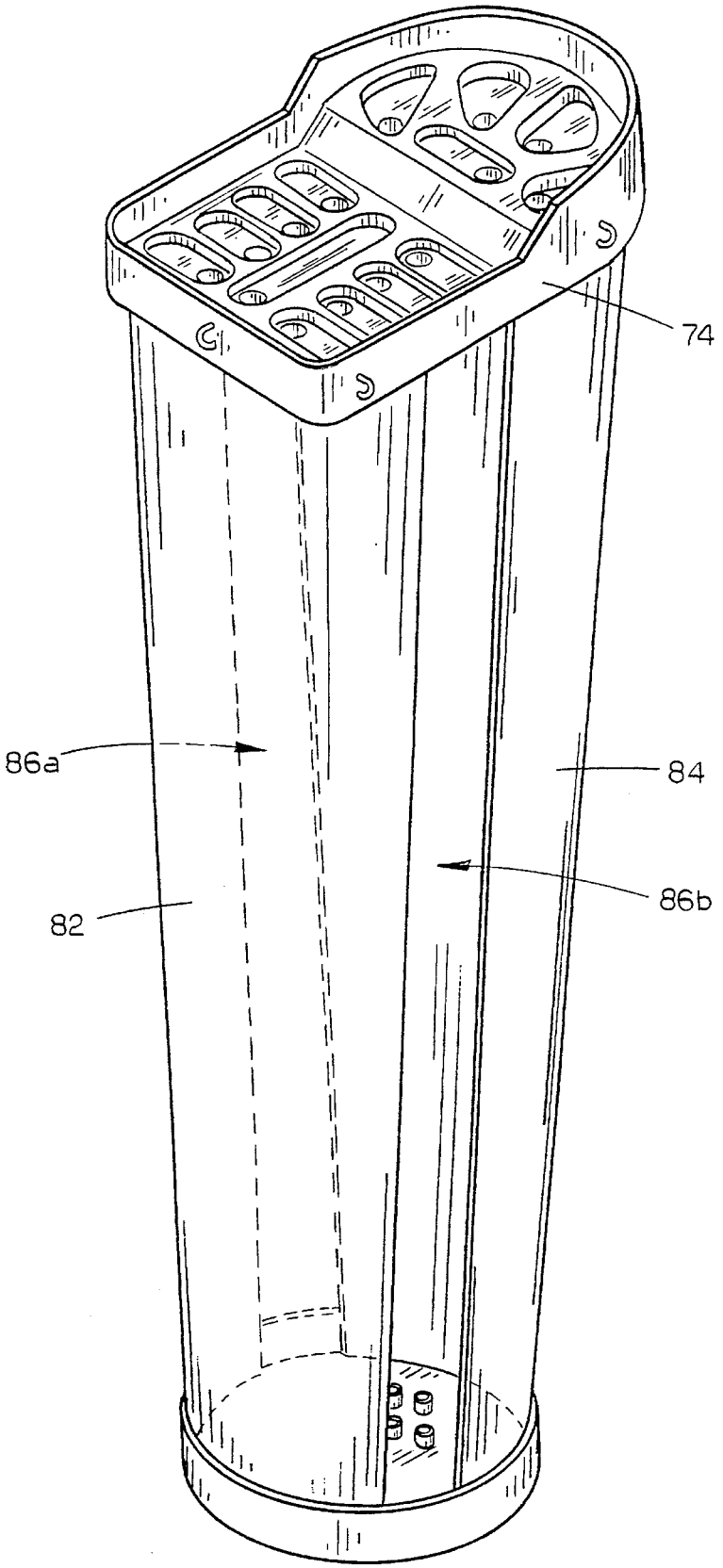
FIG. 13 is a perspective view of an alternative embodiment of the golf bag frame of FIG. 12 showing semi-cylindrical shell halves for supporting the upper club head support.

FIG. 13 exhibits an alternative embodiment of the golf bag of the present invention with the dowels 30*a–d* being replaced by front and rear semi-cylindrical shell halves 82 and 84, which provide support for the upper club head support 74 which is similar to that shown in FIG. 12. This shell embodiment provides additional protection for club shafts 40 held within the golf bag. Access to the interior of the golf bag is gained through openings 86*a* and 86*b* between the front half 82 of the shell and rear half 84 of the shell. It is preferred that bag material 150 be extended between and attached to the upper club head support 14 and lower base section 32 to cover and enclose the front and rear semi-cylindrical shell halves 82 and 84. One or more zippers 152 may be provided to allow access through the openings 86*a* and 86*b* to the interior of the golf bag 10, as shown in FIG. 12. The front and rear halves 82 and 84 of the shell may be mounted on the lower base section 32 by any convenient fastening means, such as rivets or thermal welding. An additional advantage of this embodiment is that the upper club head support 74 is more securely supported, as the golf bag may not twist about a center upright axis to the same degree allowed when dowels 30*a–d* are used to support the upper club head support. The embodiment of FIG. 13 will appear as shown in FIG. 12 when bag forming material 150 is extended over the semi-cylindrical shell halves 82 and 84.

Figure 14:
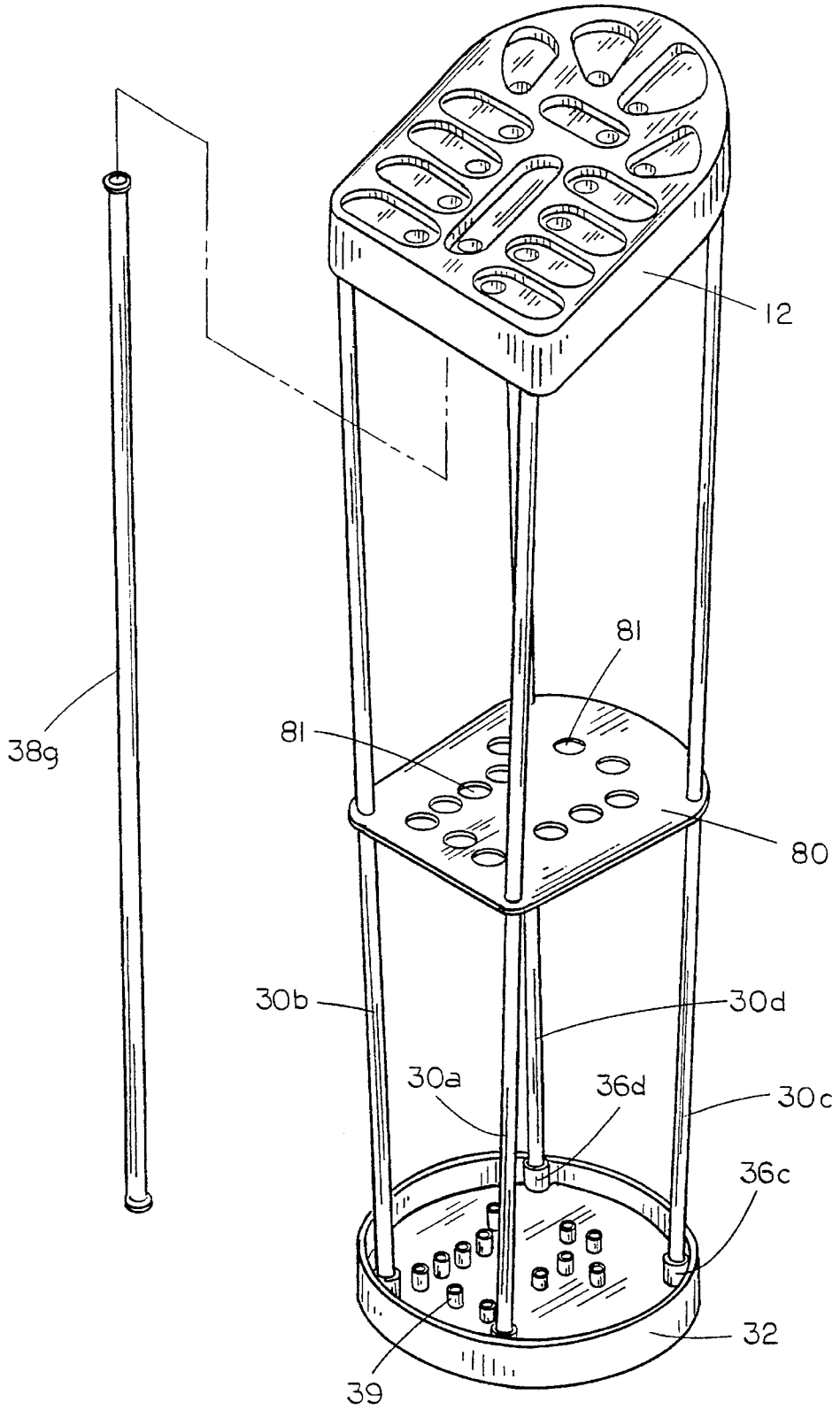
FIG. 14 is a perspective view of an alternative embodiment of the golf bag frame including a stabilizing shelf.

FIG. 14 exhibits the original embodiment of the present invention including a stabilizer shelf 80 mounted on the dowels 30 *a–d* between the upper club head support 12 and lower base section 32. The stabilizer shelf 80 may be a plate as shown in FIG. 14, or alternatively could be similar to the upper club head support 12 to provide greater stability. Preferably, the shelf 80 is designed to allow shaft tubes 38*a–n* to freely extend therethrough by providing shaft tube holes 81 at desired locations determined by the locations of the shaft receiving holes 22*a–n* on the upper club head support 12. The shelf 80 thus provides additional axial stability for the golf bag of the present invention.

Figure 15:
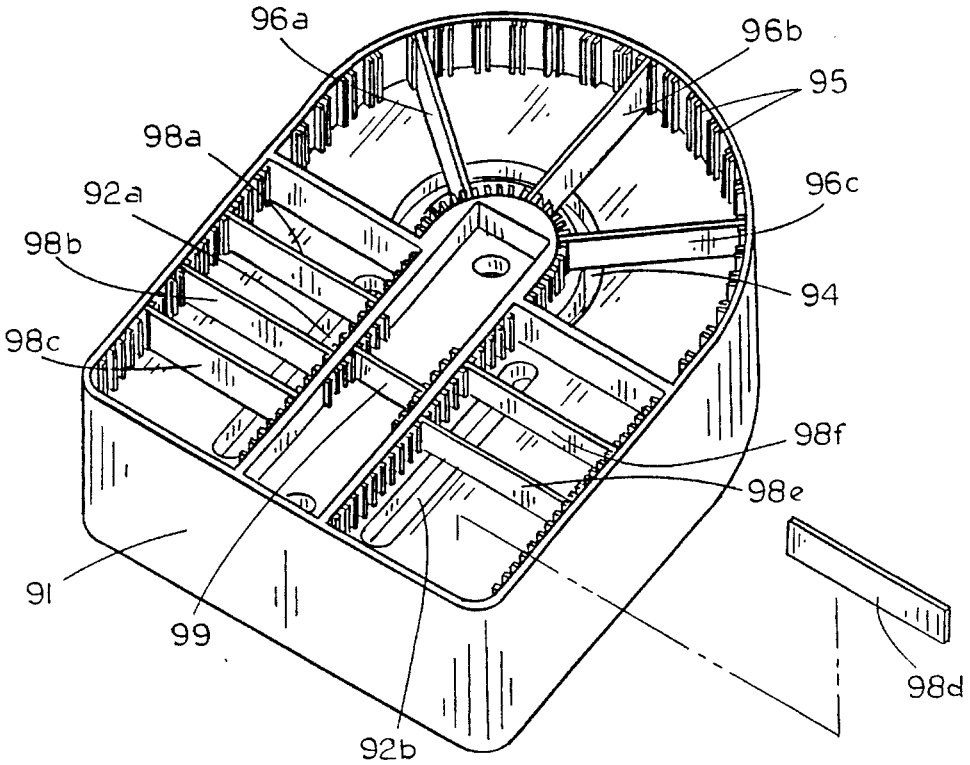
FIG. 15 is a perspective view of an alternative embodiment of the upper club head support of the golf bag including movable pocket walls.
Figure 16:
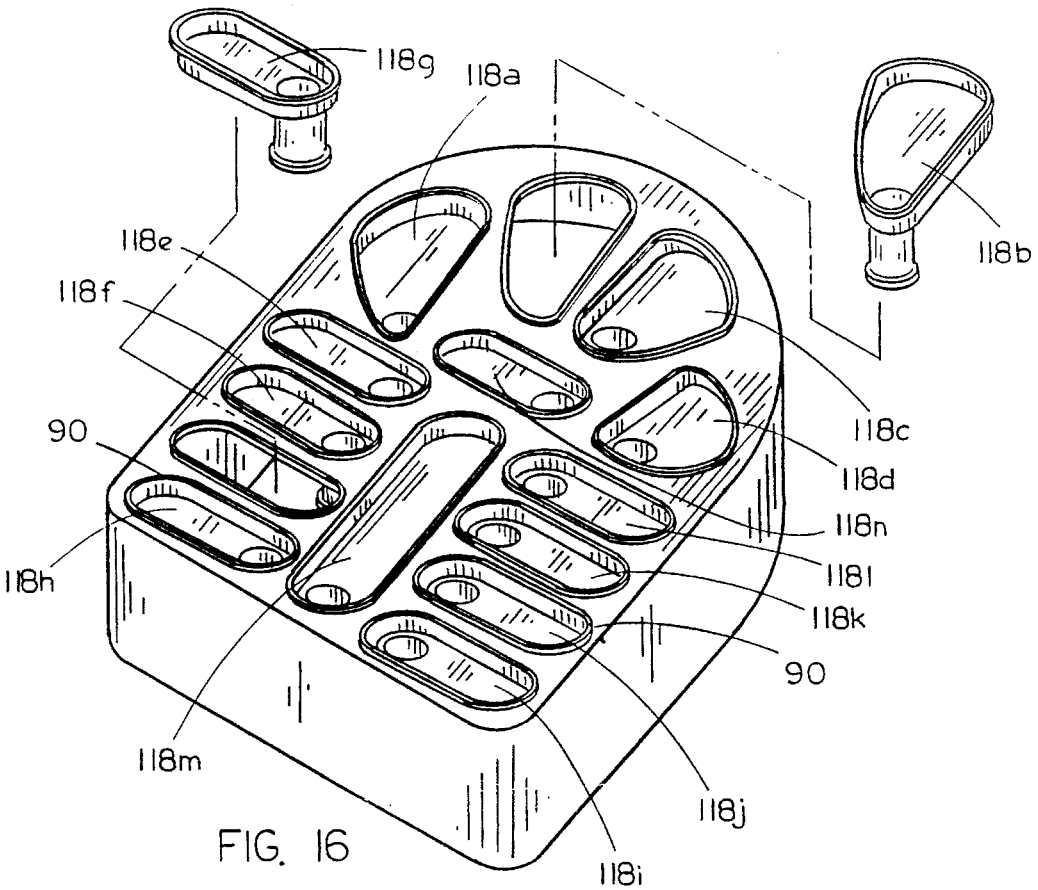
FIG. 16 is a perspective view of an alternative embodiment of the upper club head support of the golf bag including removable pockets.

FIGS. 15 and 16 exhibit two alternative embodiments of the upper club head support. FIG. 15 exhibits an upper club head support having the shaft receiving holes 22*a–n* replaced by shaft receiving slots 92*a*, 92*b* and 94. The use of slots 92*a*, 92*b* and 94 to replace the shaft receiving holes 22*a–n* allows a user of this embodiment to adjust the pocket size to accommodate any desired club head. Adjustment of pocket size is accomplished by providing various movable dividers 96*a–c* and 98*a–f* which replace the interior walls of the previous pockets 18*a–n*. Divider ridges 95 are provided to secure the various dividers in place. Three wood dividers 96*a–c* are shown, although a greater or lesser number of dividers may be used with this embodiment. Likewise, six iron dividers 98*a–f* are exhibited, a greater or lesser number of which may be used. Finally, a putter divider 99 may be provided to accommodate various sizes of putters. Of course, FIG. 15 exhibits only one embodiment having movable dividers, there being many alternative embodiments which may constructed.

FIG. 16 exhibits an embodiment of the upper club head support having removable pockets 118*a–n* similar in design to those permanent pockets described previously. Each pocket 118*a–n* is removable from the upper club head support 12 to allow for cleaning and/or replacement of the pocket. Ridges 90 provide the securement means for the removable pockets, as each removable pocket 118*a–n* would preferably be constructed to include a snap fit securement lip such as that found on resealable cans and the like. This embodiment would simplify the cleaning of the upper club head support 12 of the golf bag and also enable the user of the golf bag to replace worn out or old pockets without having to replace the entire golf bag.

Figure 17:
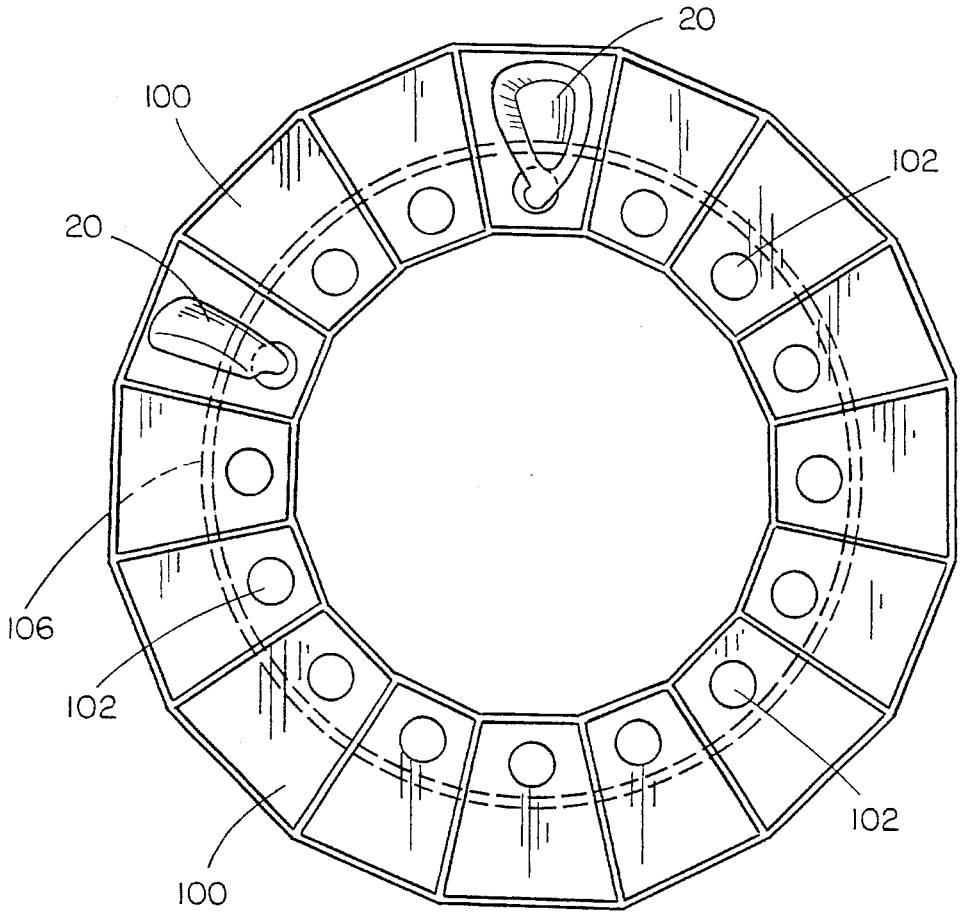
FIG. 17 is a top plan view of an alternative embodiment of the golf bag showing a plurality of pockets mounted on a standard golf bag.
Figure 18:
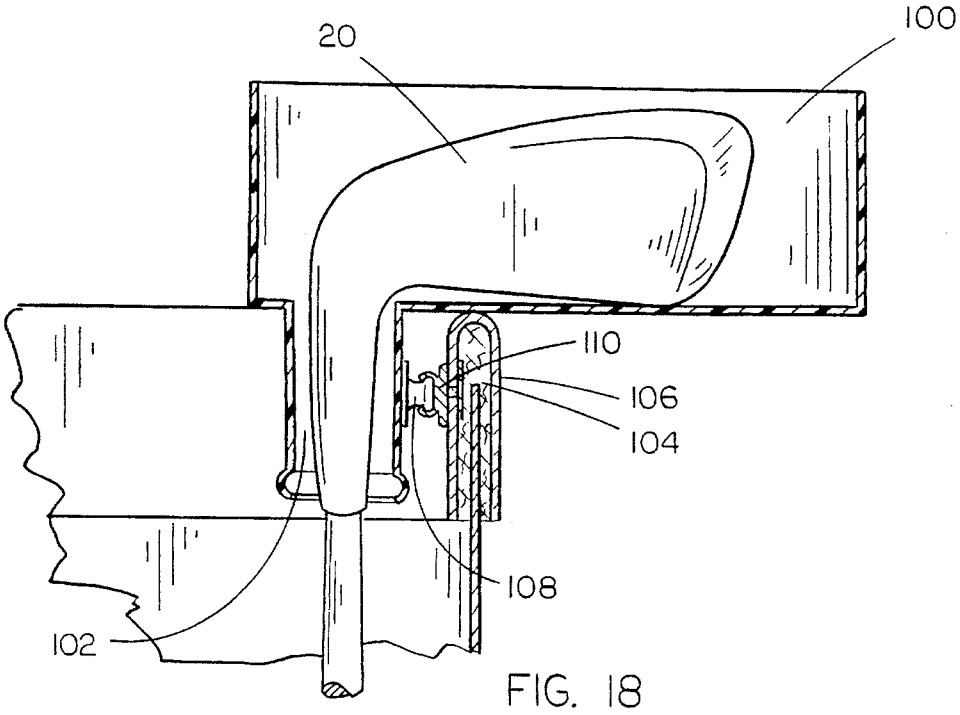
FIG. 18 is a side sectional view of a single golf club pocket of the embodiment of FIG. 17.

Finally, FIGS. 17 and 18 exhibit an alternative embodiment of the golf bag of the present invention including individual pockets mounted on the outer rim of a standard golf bag. To attach the pockets of the present invention to a standard golf bag, an outer rim cover 106 may be slid over the outer rim 104 of a standard golf bag. The outer cover 106 has one half of a fastening element, such as a snap 110, attached to the inner face of the outer rim cover 106. A plurality of attachment devices may be provided, spaced around the outer rim cover 106. Each pocket 100 is substantially similar to the pockets previously described, each pocket 100 including a shaft receiving hole 102. Mounted on the outer surface of the shaft receiving hole 102 is the second half of the attachment device, shown in FIG. 18 as a snap 108. The snap sections 108 and 110 may be connected to one another, thus attaching the pocket 100 to the outer rim cover 106, and thus to the outer rim 104 of the standard golf bag. When a plurality of pockets are attached to the golf bag, a pocket arrangement such as shown in FIG. 17 results. In this manner, the club head pockets of the present invention may be used on a standard golf bag.

While the invention has been described with a high degree of particularity, it will be appreciated by those skilled in the art that numerous modifications and substitutions may be made to the golf bag of the present invention. For example, additional club head pockets may be provided to accommodate additional club heads such as a sand wedge or the like. Furthermore, the number and location of pockets may be changed as well as the overall dimensions of the golf bag. Therefore, it is to be understood that the above description is not intended in any way to limit the scope of the present invention, which shall follow from the claims set forth below.

There has thus been set forth and described an invention which accomplishes at least all of the stated objectives.

We claim:

1. A golf bag for supporting a plurality of golf clubs, each including a shaft and a club head having a toe, a heel and front and rear faces, said golf bag comprising;

an upper club head support including a plurality of removable pockets each having a shaft-receiving hole formed therein;

a plurality of pocket-receiving openings formed in said upper club head support, each of said pockets further including connecting means for removably connecting said pockets to said upper club head support, each of said openings further including a peripheral ridge, said pockets adapted to fit into and be secured in said openings in said upper club head support by engagement of said connecting means with said peripheral ridges on said openings;

each of said pockets being of a size and shape to support and protect a club head upon insertion of a golf club, shaft first into said pocket, with the golf club shaft extending through said shaft-receiving hole to an extent that the upper part of the club head is supported by and protected within said pocket;

each of said pockets comprising a generally open-topped box shape having a bottom wall, a plurality of side walls mounted to and extending upwards from said bottom wall, said shaft-receiving hole being formed in said bottom wall and said bottom wall extending from said shaft-receiving hole to underlie the toe of a club head supported within said pocket and one of said side walls extending upwardly from said bottom wall at a position to partially laterally enclose the toe of a club head supported therein;

a lower base section for supporting said golf bag;

support means extending between and connected to said upper club head support and said lower base section such that said upper club head support is supported in spaced relation from said lower base section;

means for providing connection between said support means and said upper club head support;

means for providing connection between said support means and said lower base section;

bag-forming material attached to and extending between said upper club head support and said lower base section whereby the interior area of said bag may be protected; and said pockets formed such that each club head supported by said upper club head support is fully protected from contact with any other club head supported thereby.

2. In combination:

a golf bag having a peripheral collar upper section;

a plurality of club head protecting pockets each having a shaft-receiving hole formed therein;

each of said club head protecting pockets formed to support and protect a club head upon insertion of a golf club, shaft first into said pocket, with the golf club shaft extending through said shaft-receiving hole to an extent that the upper part of the club head is supported by and protected within said pocket;

mounting means for mounting said club head protecting pockets on said upper section of said golf bag such that an upper club head support area is formed;

said pockets formed such that each club head supported in said upper club head support area is fully protected from contact with any other club head supported thereby and that each club head within said golf bag is fully protected from all other club heads therein;

each of said pockets comprising a generally open-top box shape having a bottom wall, a plurality of side walls mounted on and extending upward from said bottom wall, said bottom wall including said shaft-receiving hole formed therein, mounting means for mounting a shaft cylinder in registration with said shaft-receiving hole;

a plurality of shaft cylinders each mounted in registration with one of said shaft-receiving holes on said bottom wall and depending downwards therefrom whereby the club head and lower part of the club shaft may be protected;

a plurality of snap-fit connectors, one mounted on the outer surface of each one of said shaft cylinders;

said mounting means for mounting said pockets on said peripheral collar upper section further including a plurality of snap-fit connectors mounted on an inner surface of said peripheral collar upper section such that said snap-fit connectors on said outer surface of said shaft cylinders may engage said snap-fit connectors mounted on said inner surface of said peripheral collar upper section thereby securing said pockets on said peripheral collar upper section.

3. In combination:

a golf bag having a peripheral collar upper section;

a plurality of club head protecting pockets each having a shaft-receiving hole formed therein;

each of said club head protecting pockets formed to support and protect a club head upon insertion of a golf club, shaft first into said pocket, with the golf club shaft extending through said shaft-receiving hole to an extent that the upper part of the club head is supported by and protected within said pocket;

mounting means for mounting said club head protecting pockets on said upper section of said golf bag such that an upper club head support area is formed;

said pockets formed such that each club head supported in said upper club head support area is fully protected from contact with any other club head supported thereby and that each club head within said golf bag is fully protected from all other club heads therein;

each of said pockets comprising a generally open-topped box shape having a bottom wall, a plurality of sidewalls mounted on and extending upward from said bottom wall, said bottom wall including said shaft-receiving hole formed therein, mounting means for mounting a shaft cylinder in registration with said shaft-receiving hole;

a plurality of shaft cylinders each mounted in registration with one of said shaft-receiving holes on said bottom wall depending downwards therefrom whereby the club head and lower part of the club shaft may be protected;

a plurality of snap-fit connectors, one mounted on the outer surface of each of said shaft cylinders;

said mounting means for mounting said club head protecting pockets on said upper section of said golf bag further comprising a peripheral collar cover formed to fit over and frictionally secure on said peripheral collar upper section, said peripheral collar cover further comprising a plurality of snap-fit connectors mounted on an inward facing surface of said peripheral collar cover for releasably engaging said snap-fit connectors mounted on said outer surfaces of said shaft cylinders of said pockets such that a plurality of pockets may be supported in circumferential relation on said peripheral collar cover.

* * * * *